US009038771B1

(12) United States Patent
Mueller

(10) Patent No.: US 9,038,771 B1
(45) Date of Patent: May 26, 2015

(54) FIREARM SILENCER

(71) Applicant: Peter Michael Mueller, Frederick, CO (US)

(72) Inventor: Peter Michael Mueller, Frederick, CO (US)

( * ) Notice: Subject to any disclaimer, the term of this patent is extended or adjusted under 35 U.S.C. 154(b) by 0 days.

(21) Appl. No.: 14/194,806

(22) Filed: Mar. 2, 2014

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 181/223; 89/14.4
See application file for complete search history.

(56) References Cited

U.S. PATENT DOCUMENTS

| | | | | |
|---|---|---|---|---|
| 4,726,280 | A * | 2/1988 | Frye | 89/16 |
| 5,685,102 | A * | 11/1997 | Latka | 42/85 |
| 7,328,645 | B1 * | 2/2008 | Curry et al. | 89/14.3 |
| 7,789,009 | B1 * | 9/2010 | Brittingham | 89/14.4 |
| 8,424,635 | B1 * | 4/2013 | Klawunn | 181/223 |
| 8,714,301 | B2 * | 5/2014 | Shults | 181/223 |
| 8,857,306 | B1 * | 10/2014 | Edsall | 89/14.05 |
| 8,857,307 | B2 * | 10/2014 | Tresserras Torre et al. | 89/14.4 |
| 2012/0152093 | A1 * | 6/2012 | Koumbis | 89/14.4 |
| 2014/0020977 | A1 * | 1/2014 | Shults | 181/223 |
| 2014/0224574 | A1 * | 8/2014 | Latka | 181/223 |
| 2014/0231168 | A1 * | 8/2014 | Dueck et al. | 181/223 |
| 2014/0318887 | A1 * | 10/2014 | Latka | 181/223 |

* cited by examiner

*Primary Examiner* — Forrest M Phillips

(57) ABSTRACT

A firearm silencer for suppressing sound intensity generated by the discharge of a firearm, the discharge generating propellant gases, is disclosed. The firearm silencer includes an outer tube. The outer tube is generally hollow and generally cylindrical. The firearm silencer also includes a monolithic baffle stack inserted within the outer tube, and the monolithic baffle stack positions and constrains the outer tube coaxially and axially at a first and second end of the outer tube relative to a first and second end of the monolithic baffle stack using seals and retention seals, with such seals also providing an atmospheric sealing function. The monolithic baffle stack includes a first end that includes a first hole. The monolithic baffle stack also includes a second end that includes a second hole. The second end is located opposite the first end of the monolithic baffle stack. The monolithic baffle stack further includes a plurality of chambers in fluid communication with each other via a plurality of holes and annular void. The monolithic baffle stack also includes a plurality of recesses in fluid communication with the plurality of chambers via a plurality of through holes and annular void. The monolithic baffle stack also further includes plurality of protrusions and plurality of lands within the plurality of chambers where said lands and plurality of holes in chambers form an equivalent cylindrical bore dimension. Moreover, the firearm silencer includes a path extending from the first hole adjacent the first end of the monolithic baffle stack through the first hole adjacent the second end of the monolithic baffle stack. The plurality of chambers, the plurality of recesses, the plurality of through holes, the plurality of protrusions, the plurality of lands, the annular void, and the path are configured to allow propellant gases to travel there through.

11 Claims, 8 Drawing Sheets

Section K_K

Detail E

Section L-L

FIREARM SILENCER

BACKGROUND

1. Technical Field

The present disclosure relates generally to silencers, and more particularly, to silencers for firearms.

2. Background of Related Art

When a firearm is fired multiple sounds may be generated. These sounds may be generated from ignition of a round, from the discharge of propellant gas from the end of the barrel of a firearm, from the bullet in flight, from the bullet when it finds terminal impact, etc. Multiple techniques may be employed to address these sounds. Typically a silencer may be capable of attenuating some of these sounds associated with firing of the firearm.

A silencer generally takes the form of a cylindrically shaped metal tube with various internal mechanisms to reduce the sound of firing by slowing the escaping propellant gas and sometimes by reducing the velocity of the bullet. The silencer is typically made of metal (e.g. steel, Aluminum, or titanium) that can withstand the heat associated with the escaping propellant gas. Efforts have been made to reduce the overall weight of the silencer. However, efforts to build lighter silencers have compromised the durability of the silencers by using thin metals. Also, efforts to build lighter and quieter silencers have resulted in complex assemblies of many parts, sometimes requiring tools to assist in assembly/disassembly.

A silencer may include a cylindrical core containing expansion chambers. The silencer may be attached to the barrel of a firearm. The silencer may also be attached to different firearms of the same caliber. (Caliber refers to the approximate diameter of the barrel bore (and the bullet) of a firearm, which is generally measured in inches or millimeters.

A silencer may help to reduce noise by trapping the propellant gases from the firing of the cartridge inside a series of hollow (expansion) chambers. As the trapped gas expands, migrates, and cools through the series of chambers, its pressure and velocity decrease by thermodynamic principles. This results in sound wave attenuation. The series of chambers may be divided by baffles, which are metal dividers that separate the expansion chambers. Each baffle may include a hole aligned to the barrel bore to permit the passage of the bullet through the silencer. The hole is typically larger than the bullet caliber to minimize the risk of "baffle strike" i.e. the bullet contacting the baffle. Baffles may be made of similar or different material as the cylindrical core. The shape of each baffle may include a flat or a curved surface. One popular technique includes forming a stack of baffles using alternating angled flat surfaces. In this technique the stack of baffles may be welded to the cylindrical core. By doing so, however, the stack of baffles may not be removed from the cylindrical core for replacement or for cleaning purposes.

In another technique a stack of baffles may be formed by welding individual baffles together. The stack of baffles may then be welded to the cylindrical core. In this technique, the joints where the individual baffles are welded together, or where the stack of baffles are welded to the cylindrical core may suffer from fatigue over time and may eventually become a point of failure. In addition, the materials used in forming the welded joints may increase the overall weight of the silencer.

Also of common technique is the use of multiple components to capture and restrain the cylindrical metal tube, both axially and concentrically, and internal components as an assembly in direct contact with each other using threads, fasteners, and features in the components and usually involving tools for assembly and disassembly. This creates complex component manufacturing features and increases both ease of use difficulty, and cost, as well as failure point considerations.

The apparatus of the present disclosure are directed toward improvements in the existing technology.

SUMMARY

In one aspect the present disclosure may be directed to a firearm silencer (silencer) for attenuating sounds generated by the discharge of a firearm. The discharge may generate propellant gases. The silencer may include an outer tube. The outer tube may be generally hollow and generally cylindrical. The silencer also may include a monolithic baffle stack inserted coaxially within the outer tube. The monolithic baffle stack may include a first end that may include a first hole. The monolithic baffle stack also may include a second end that may include a second hole. The second end may be located opposite the first end of the monolithic baffle stack. The monolithic baffle stack further may include a plurality of chambers in fluid communication with each other via a plurality of holes. The monolithic baffle stack also may include a plurality of recesses in fluid communication with the plurality of chambers, via an annular spacing between the inside diameter of the outer tube and the outside of the monolithic baffle, and/or via through holes. The silencer further may include a single or plurality of seal grooves at the first and second end of the monolithic baffle stack in which seals are disposed therein. The seals may be positioned within the seal grooves to allow for contact with the outside diameter of the seal groove and the inner diameter of the outer tube surface by the seal material so as to form a closed fluid chamber of the silencer assembly between the outer tube and monolithic baffle stack except for the first and second hole of the monolithic baffle stack. Additional seal grooves and corresponding seals may also be positioned along the monolithic baffle stack longitudinal baffle stack axis so as to form multiple fluid communication paths through the monolithic baffle stack/outer tube combination. The outer tube may be retained axially between the first and second end of the monolithic baffle stack via removable retention components secured to the monolithic baffle stack outboard of either end of the outer tube upon assembly. Moreover, the silencer may include a path extending from the first end of the monolithic baffle stack through to the second end of the monolithic baffle stack. The plurality of chambers, the plurality of recesses, the annular spacing, the through holes, and the path may be configured to allow propellant gases to travel there through.

In another aspect, the present disclosure may be directed to a silencer for attenuating sounds generated by the discharge of a firearm. The discharge may generate propellant gases. The silencer may include an outer tube. The outer tube may be generally hollow. The silencer also may include a monolithic baffle stack inserted within the outer tube. The monolithic baffle stack further may include a plurality of chambers in fluid communication with each other via a plurality of holes. The monolithic baffle stack also may include a plurality of recesses in fluid communication with the plurality of chambers via an annular spacing between the inside diameter of the outer tube and the outside of the monolithic baffle, and/or via through holes. The silencer further may include a single or plurality of seal grooves at the first and second end of the monolithic baffle stack in which seals are disposed therein. The seals may be positioned within the seal grooves to allow for contact with the outside diameter of the seal groove and the inner diameter of the outer tube surface by the seal material so as to form a closed fluid chamber of the silencer assembly between the outer tube and monolithic baffle stack except for the first and second hole of the monolithic baffle stack, and also position the outer tube and monolithic baffle stack so as to form the annular spacing there between. The outer tube may be restrained axially to the monolithic baffle stack via the resulting friction of compression of the seals between the outer tube and monolithic baffle stack upon assembly. Moreover, the silencer may include a path extending from the first end of the monolithic baffle stack through to the second end of the monolithic baffle stack. The plurality of chambers, the plurality of recesses, the annular spacing, the through holes, and the path may be configured to allow propellant gases to travel there through.

In yet another aspect of the present disclosure is directed to a method of assembling a silencer for suppressing sounds generated by the discharge of a firearm. The discharge may generate propellant gases. The method may include providing an outer tube. The outer tube may be generally hollow and generally cylindrical. The method may also include providing a monolithic baffle stack which may be inserted coaxially within the outer tube. The monolithic baffle stack may include a first end that may include a first hole. The monolithic baffle stack also may include a second end that may include a second hole. The second end may be located opposite the first end of the monolithic baffle stack. The monolithic baffle stack further may include a plurality of chambers in fluid communication with each other via a plurality of holes. The monolithic baffle stack also may include a plurality of recesses in fluid communication with the plurality of chambers via an annular spacing between the inside diameter of the outer tube and the outside of the monolithic baffle, and/or via through holes. The method further may include a single or plurality of seal grooves at the first and second end of the monolithic baffle stack in which provided seals may be installed therein. The method may include installing the seals within the seal grooves to allow for contact with the outside diameter of the seal groove and the inner diameter of the outer tube surface by the seal material so as to form a closed fluid chamber of the silencer assembly between the outer tube and monolithic baffle stack except for the first and second hole of the monolithic baffle stack. Additional seal grooves may also be included along the monolithic baffle stack axis so as to form multiple fluid communication paths through the monolithic baffle stack/outer tube combination and the method may include the installation of additional seals for these grooves. Also, the method may include the outer tube being retained axially between the first and second end of the monolithic baffle stack by providing removable retention components and may include securing the retention components to the monolithic baffle stack outboard of either end of the outer tube upon assembly. Moreover, the silencer may include a path extending from the first end of the monolithic baffle stack through to the second end of the monolithic baffle stack. The plurality of chambers, the plurality of recesses, the annular spacing, the through holes, and the path may be configured to allow propellant gases to travel there through.

BRIEF DESCRIPTION OF THE DRAWINGS

The accompanying drawings, which are incorporated in and constitute a part of this specification, illustrate embodiments of the present disclosure and, together with the detailed description of the embodiments given below, serve to explain the principles of the disclosure.

DETAILED DESCRIPTION

Figure 1:
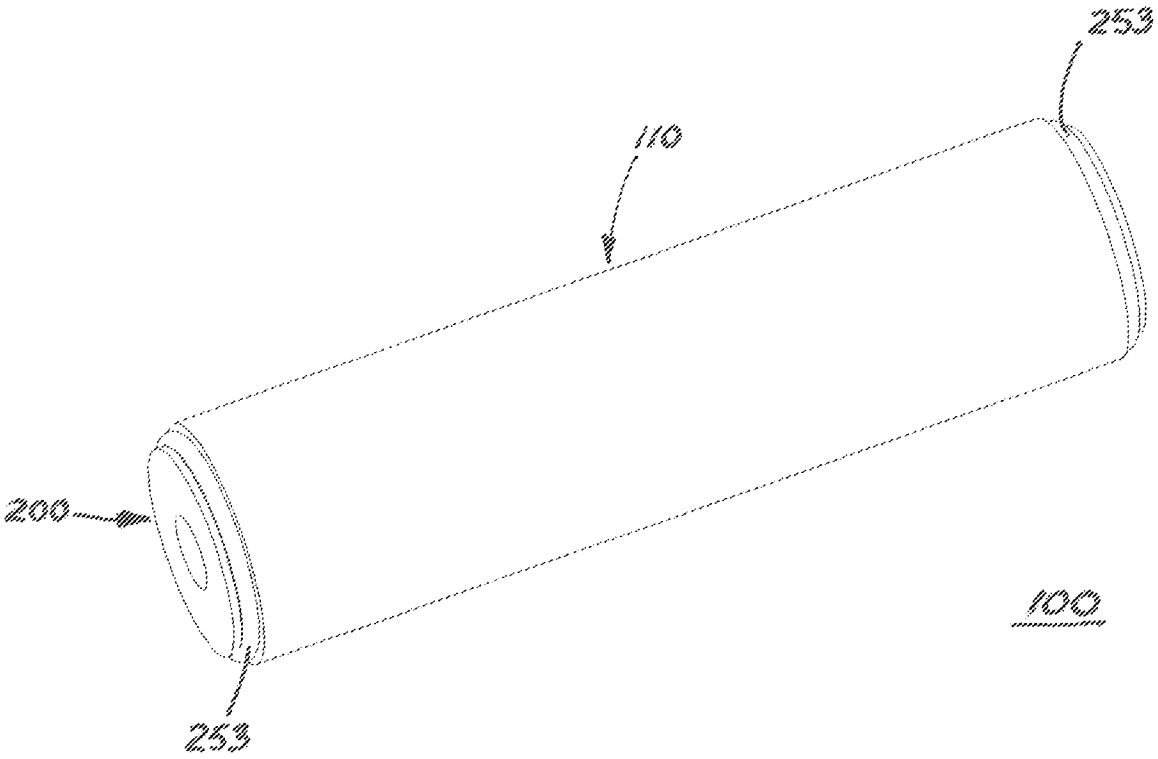
FIG. 1 is an external perspective view of an exemplary embodiment of firearm silencer.

An exemplary embodiment of a firearm silencer 100 (silencer 100) for reducing sounds generated during firing of a firearm is illustrated in FIG. 1. In the embodiment as shown, silencer 100 is fully assembled. In some embodiments silencer 100 may include an outer tube 110, a monolithic baffle stack 200, retention seals 253, and seals 252 (shown in FIG. 2). Once assembled, silencer 100 may be selectively attached to a firearm. Silencer 100 may include two ends. In the embodiment as shown, silencer 100 includes one end that coincides with an end of monolithic baffle stack 200. Also as shown, silencer 100 includes another end that coincides with the opposite end of monolithic baffle stack 200. As will be explained in further detail below, one end of silencer 100 may be threaded. It is contemplated that silencer 100 may be selectively attached to a firearm via one threaded end. For illustrative purposes, the preferred embodiment is for the silencer to be attached at a single end as will be further explained. However, one may contemplate that the silencer 100 may be attached to the firearm at an either threaded end, and this may be readily apparent to one skilled in the art.

Figure 2:
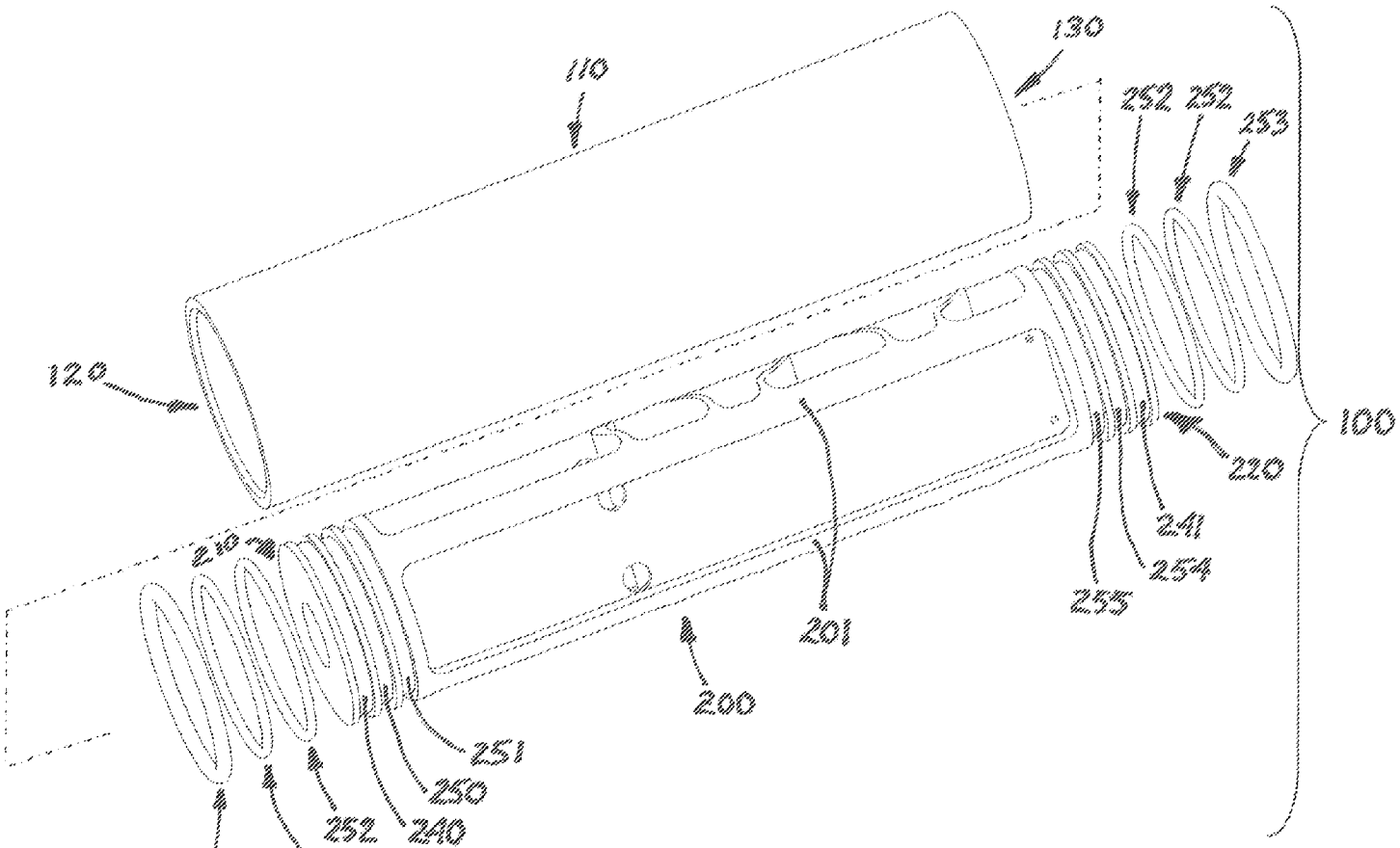
FIG. 2 is an exploded perspective view of an exemplary embodiment of firearm silencer showing components monolithic baffle stack, outer tube, seals, and retention seals.

FIG. 2 illustrates an exemplary embodiment of silencer 100 in a disassembled state. e.g., before the various components of silencer 100 are assembled. Those skilled in the art would appreciate that because silencer 100 may be disassembled easily, the life and durability of silencer 100 may be increased. For example, any component of silencer 100 may be replaced. Thus, instead of replacing silencer 100 in its entirety when any component requires replacement, only the damaged component needs to be replaced.

Still referring to FIG. 2, outer tube 110 may be a generally hollow and cylindrical tube. Outer tube 110 may represent other geometric shapes that may be suitable for use in a silencer. For example, outer tube 110 may be in the shape of a prism, a box, or any other polygon. Outer tube 110 may include a first end 120 and a second end 130. In some embodiments first end 120 and second end 130 may terminate in different outer and/or inner diameter dimensions. Outer tube 110 may be approximately 4 to 15 inches in length and may be approximately ¾ to 3 inches in outside diameter for example.

The outer tube 110 length may be selected as appropriate to ensure contact with sealing and retention elements of the assembly as may be described later. It is contemplated that other dimensions of outer tube 110 may be appropriate depending on the type of firearm for which silencer 100 is designed.

In some embodiments outer tube 110 may be made of aluminum. In other embodiments, outer tube 110 may be made of other metal such as steel, titanium, copper, brass, metal alloys, or any appropriate metal, composite material, or polymer. It is contemplated that the various components of silencer 100 may be made of the same material. In the preferred embodiment, the various components of silencer 100 may be made of aluminum. A silencer made of aluminum may be lower in weight as compared to a silencer made of steel. Those skilled in the art would appreciate that a lightweight silencer may be preferable over a heavier silencer.

Also contemplated is the use of coatings in aiding resistance to wear and for thermodynamic performance considerations of the silencer 100, and are hereby described but not shown in the Figures since they constitute surface treatments. In some embodiments one may contemplate coating the monolithic baffle stack 200 with wear resistant and/or thermal coatings. For example, in some embodiments, one may use a high temperature ceramic coating of low thermodynamic transmission properties to limit heat degradation and particle impingement wear in the monolithic baffle stack 200. One may also prefer a high temperature ceramic coating of high heat dissipative properties to assist in thermal heat dissipation to the atmosphere and the limitation of particle impingement wear in the outer tube 110, and such contemplation is included in some embodiments. Also, some embodiments may contemplate the use of high temperature silicone rubber material for the composition of seals 252 and retention seals 253 to ensure sealing and capture function performance during use of the silencer 100 over the operational temperature range it may encounter or generate. Other coating techniques may be left to embody in the silencer 100 and may be evident by one skilled in the art.

As shown in FIG. 2, baffle stack 200 may be a monolithic baffle stack, i.e. a single piece baffle stack as opposed to being made from multiple individual baffles. Using a monolithic unit may help to minimize or eliminate point of impact shift (i.e. deviation between a target path and the actual path of the bullet) during firing of a firearm.

Monolithic baffle stack 200 may be approximately 4½ inches to 16 inches in length and approximately ¾ inch to 2⅞ inches in diameter. In the embodiment as shown, baffle stack 200 includes a first end 210 that includes a first groove 240, a second groove 250, and a third groove 251. As will become clear to one skilled in the art, third groove 251 is shown as a preferred embodiment but may not be present or may be present in plurality relative to descriptions of seals in the new invention. First groove 240 may have a width, i.e. distance measured along a longitudinal axis extending from first end 210 to second end 220 of approximately 0.03 inch to 0.25 inch. Second groove 250 and third groove 251 may have a similar width of approximately 0.03 inch to 0.25 inch. First groove 240 may have a diameter of approximately ⅝ inch to 2¾ inch. Second groove 250 and third groove 251 may have a diameter less than the diameter of first groove 240, and which may be approximately 0.03 inch to 0.125 inch less.

Also in the embodiment as shown, baffle stack 200 includes a second end 220 that includes a first groove 241, a second groove 254, and a third groove 255. As will become clear to one skilled in the art, third groove 255 is shown as a preferred embodiment but may not be present or may be present in plurality relative to descriptions of seals in the new invention. Also, groove 255 or any additional grooves may have geometries dissimilar to groove 254 and groove 241. Groove 254, groove 255, and groove 241 may be dissimilar in longitudinal location and groove dimension relative to second end 220, from groove 251, groove 250, and groove 240 longitudinal location and groove dimension relative to first end 210, of monolithic baffle stack 200. First groove 241 may have a width, i.e. distance measured along a longitudinal axis extending from first end 210 to second end 220 of approximately similar dimension as to first groove 240 of first end 210. Second groove 254 and third groove 255 may have a similar width of approximately similar dimension as to second groove 250 and third groove 251 of first end 210. First groove 241 may have a diameter of approximately ⅞ inch to 2⅞ inch and also may be similar in diameter to first groove 240 of first end 210. Second groove 254 and third groove 255 may have a diameter less than the diameter of first groove 241, and which may be approximately 0.03 inch to 0.125 inch less, and may have a similar diameter to second groove 250 and third groove 251 of first end 210.

Referring to FIGS. 3A-E and FIG. 4A, in some embodiments, first end 210 may include a hole 245 that may be approximately ½ inch to 1½ inches in diameter. In some embodiments, hole 245 may be threaded, i.e. approximately ½-28 UNEF to 1%-18 UNEF. Hole 245 may also have thread parameters of other description as would be found on the ends of barrels of firearms suitable for use with silencer 100. First end 210 may also include a hole 246 that may be approximately ¼inch to ⅝ inch in diameter and coaxial to hole 245. One skilled in the art may also contemplate hole 245 being of a diameter, depth, and taper without threads, and containing additional mating features to coaxially align and selectively attach silencer 100 first end 210 to a firearm barrel in a plurality of manner. Such description is apparent and the threaded hole 245 preferred embodiment is illustrated.

Figure 3B:
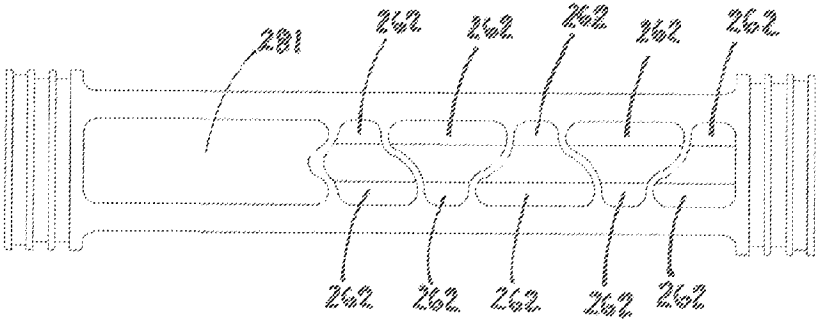
FIG. 3B is a top view of monolithic baffle stack of FIG. 2.
Figure 3A:
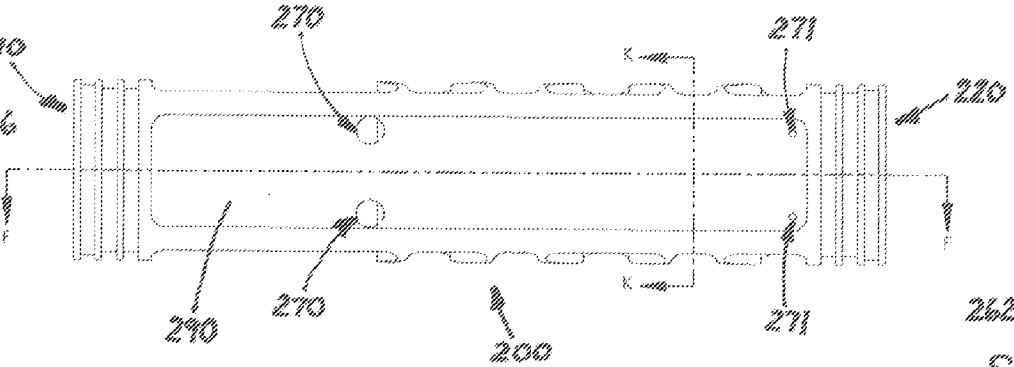
FIG. 3A is a side view of monolithic baffle stack of FIG. 2.
Figure 3C:
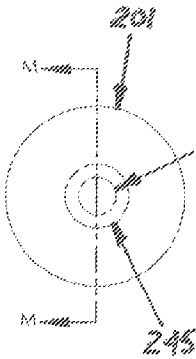
FIG. 3C is a first end view of monolithic baffle stack of FIG. 2.
Figure 3D:
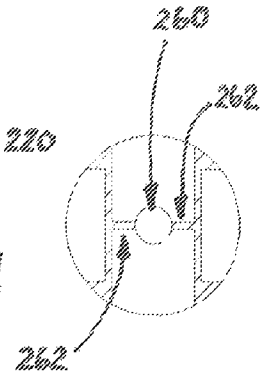
FIG. 3D is a second end view of monolithic baffle stack of FIG. 2 through Section K-K of FIG. 3A.

Monolithic baffle stack 200 includes a second end 220 that includes a hole 230. Hole 230 may be similar in size as hole 245 and/or hole 246. Monolithic baffle stack 200 may include a plurality of holes 260, a plurality of lands 261, a plurality of through holes 270, a plurality of through holes 271, a plurality of chambers 280, a first chamber 281 adjacent to hole 246 (or hole 245) and a plurality of recesses 290. Through holes 270 are located so as to allow a fluid communication between first chamber 281 and recesses 290, and are approximately ¼inch in diameter. Holes 260 may be preferably co-radial to each other, and coaxial to hole 245, hole 246, and hole 230. Through holes 271 are located so as to allow a fluid communication between chamber 281 adjacent to hole 230 and recesses 290, and are approximately 1/16 inch in diameter. In some embodiments, additional through holes of varying diameters may be contemplated for fluid communication between the remaining described chambers 280 and recesses 290, as characteristics of fluid movement to be described later are embodied to achieve performance goals of the silencer 100. In some embodiments, each of the plurality of holes 260 may be similar in size as hole 230, and may be approximately ¼ inch to ⅝ inches in diameter. As shown in FIG. 3A, the location of the plurality of through holes 270 and through holes 271 may be symmetrical with respect to a longitudinal axis extending from first end 210 to second end 220.

Lands 261 may be preferably co-radial with holes 260 and may be embodied through material removal of manufacturing the chambers 280 and holes 260. The lands 260 may be generally defined as cylindrical faces on the ends of protrusions 262 manufactured by the previously noted method.

Protrusions 262 may be generally planar in shape, may be symmetric in thickness about holes 260 axes, may extend longitudinally between first end 210 and second end 220 within the chamber 280 volumes, and may be in communication with all sides of the chamber surfaces. The preferred embodiment of the invention illustrates protrusions 262, coplanar and opposed relative to a longitudinal axis extending from the first end of the monolithic baffle stack to the second end of the monolithic baffle stack, and generally parallel to the plane generated by Section F-F.

One may contemplate that the cylindricity and straightness of the boreway formed by lands 261 and holes 260 may be manufactured with tight tolerances and slightly larger than the rifle projectile diameter so as to impart flight characteristics upon the rifle projectile, stabilizing it's flight path through non-contact (hydrodynamic and aeronautic) forces generated between the rifle projectile, the holes 260, lands 261, chambers 280 and time-dependent dynamic characteristics of the atmospheric conditions and constituents within the silencer 100 volume. While protrusions 262 are preferentially illustrated, one skilled in the art may contemplate a plurality of protrusions and resulting lands so positioned about a holes 260 axes and forming a balanced hydrodynamic/aerodynamic projectile reaction feature.

Figure 4A:
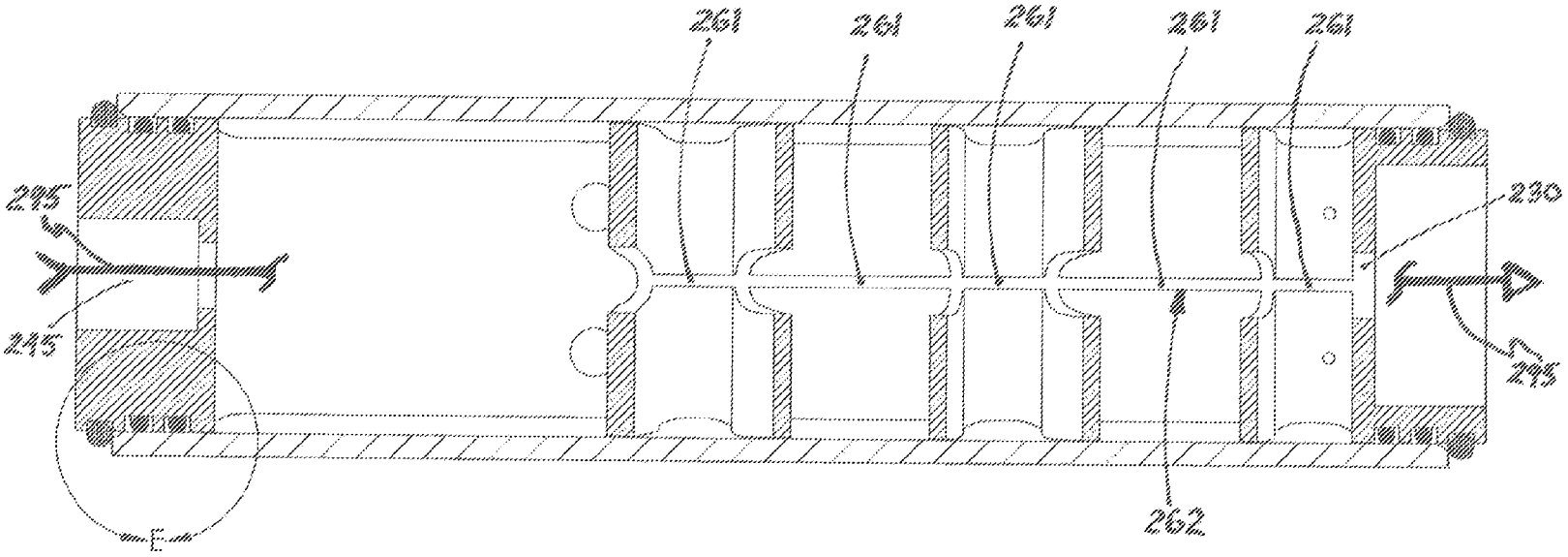
FIG. 4A is a cross-sectional view of an exemplary embodiment of firearm silencer of FIG. 1 shown in a side view through outer tube longitudinal center line axis and corresponding to Section M-M of FIG. 3C.
Figure 4B:
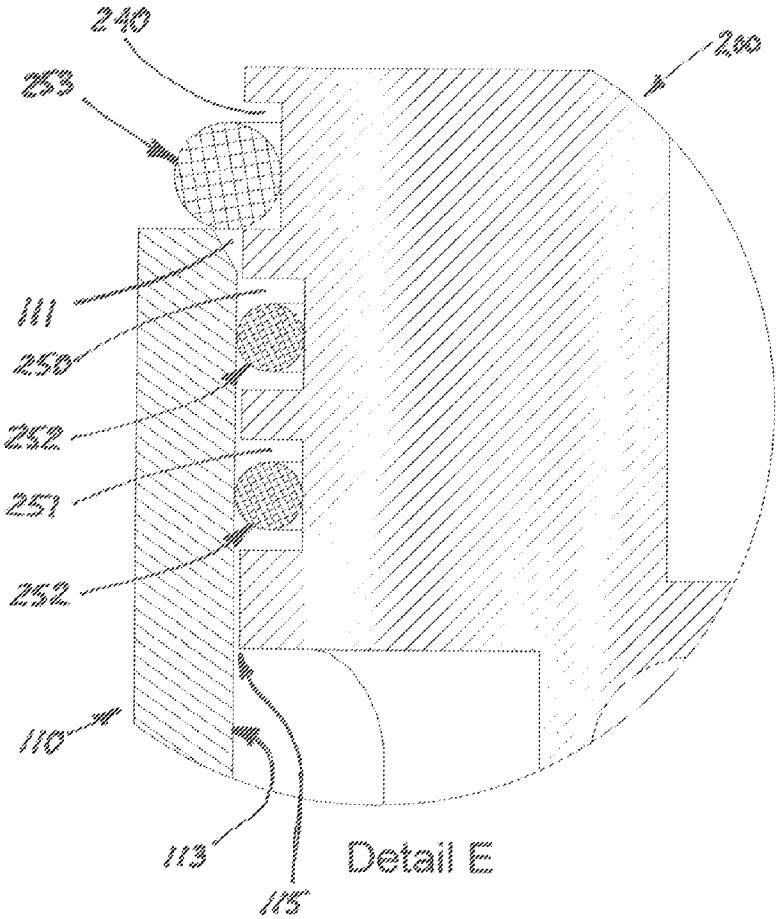
FIG. 4B is a detail view of Detail E of the FIG. 4A cross-sectional view of an exemplary embodiment of firearm silencer of FIG. 1.

Referring back to FIG. 2 and to FIG. 4B, silencer embodiment 100 may include seals 252 positioned within groove 250, groove 251, groove 254, and groove 255. Seals 252 are dimensionally manufactured to match parameters of groove 250, groove 251, groove 254, and groove 255 for high pressure seal applications, and may be preferentially the same. Although contemplated as being similar O-ring type seals, seals 252 may be dissimilar and geometrically matched to any dissimilarities in groove 250, groove 251, groove 254, and groove 255 at both first end 210 or second end 220, or other plurality of grooves if present, and may be of a different cross-section (i.e. face seal, labyrinth seal, spring seal, lip seal, etc.) or diameter. Seals 252 are preferentially of a high temperature elastomeric compound in composition (i.e. silicone rubber, tetrafluoroethylene propylene, or perfluoroelastomer), but may be composed of other materials or combinations of materials. When assembled to the silencer 100, seals 252 may be compressed or deformed, and may be in contact with the diameter of seal groove 250, groove 251, groove 254, or groove 255 while coincidentally in contact with the inside diameter of outer tube 110. As so described in the preferred embodiment, the seals 252 may be squeezed between the two aforementioned components and may form closed interior volumes within silencer 100 open to the atmosphere at only the first end 120 at hole 245, and at the second end 220 at hole 230, while supporting the outer tube 110 inner diameter concentric to and with an annular void 115 between the outer tube 110 inner diameter surface 113 and the monolithic baffle stack 200 outer diameter surface 201. The annular void 115 radial distance between the inner diameter surface 113 of outer tube 110 and outer diameter surface 201 of monolithic baffle stack 200 may be so manufactured so as to be generally less than 0.030 inch. To aid in installation of outer tube 110 over the seals 252, a chamfer 111 may be contemplated on the inside diameter edge of both the first end 120 and second end 130. The chamfer 111 may be geometrically angled and dimensioned so as to allow for a smooth squeeze of seals 252 to their compressed condition without damage, while at the same time providing for enough face area at the first end 120 and second end 130 to allow for axial capture of the outer tube by retention seal 253 as will become evident in the description to follow. While chamfer 111 is the preferred embodiment as a chamfer feature, other features (i.e. such as fillets and rounds), may be contemplated.

Referring now to Detail E of FIG. 4B, what is described as retention seal 253 may be present in seal groove 240 of monolithic baffle stack 200 at first end 210 and seal groove 241 of monolithic baffle stack 200 second end 220. In the preferred embodiment of silencer 100, seals 253 are positioned within groove 240 and groove 241. Seals 253 are dimensionally manufactured to match parameters of grooves 240 and groove 241, and may be preferentially the same. Although contemplated as being similar O-ring type seals to other seals previously described, seals 253 may be dissimilar and geometrically matched to any dissimilarities in groove 240 at first end 210 or groove 241 at second end 220, or other plurality of grooves if present, and may be of a different cross-section (i.e. face seal, labyrinth seal, spring seal, lip seal, etc.) or diameter. Seals 253 are preferentially of a high temperature elastomeric compound in composition (i.e. silicone rubber, tetrafluoroethylene propylene, or perfluoroelastomer), but may be composed of other materials or combinations of materials, and may be identical to seals 252. When assembled to the silencer 100, seals 253 are themselves in tension and may be in contact with the diameter of seal groove 240 or groove 241 while coincidentally in contact with the first end 120 or second end 130 respectively of outer tube 110. As so described in the preferred embodiment, the seals 253 may be installed and as such with a dimension of the retention seal groove 240 being larger in diameter than seal groove 250, the retention seal groove 241 being larger in diameter than seal groove 254, and so large in diameter that the retention seal 253 may not be squeezed between the inside diameter surface 113 of outer tube 110 and the diameter of seal groove 250, or the inside diameter surface 113 of outer tube 110 and the diameter of seal groove 254. The retention seals 253 may then function as an axial movement stop along the outer tube 110 longitudinal axis by being so installed at both ends of the outer tube. One skilled in the art may dispose the seal grooves 250 and 254, and seal retention grooves 240 and 241, in such a relationship from the ends of the outer tube 110 and ends of the monolithic baffle stack so as to produce a relatively axial stationary relationship between the aforementioned members while ensuring adequate margin for positioning error of the seals 252 to maintain their full functionality of pressure sealing during operation of the silencer. As so described, one may appreciate that the outer tube 110 outer ends 120 and 130 may be assembled in the new invention from either end 201 or 220 of the monolithic baffle stack 200, and result in the same finished assembly. One skilled in the art may also substitute other retention apparatus for the retention seals, i.e. retaining rings, band clamps, threaded nuts, etc., and such substitutions are deemed self-evident and not requiring further description.

It is anticipated that the fit between the seals, outer tube, and monolithic baffle stack may be of a high friction value. As such, the silencer 100 may be installed to the firearm via grasping and threading onto the end of a firearm threaded barrel as previously described utilizing only a grasping method of the outer tube. However, one may also provide for features at the first end 210 or second end 220 of the monolithic baffle stack such that hand tools in temporary communication with said features may be used to assist in installation. These features make take the form of spanner wrench holes, hex sockets, wrench flats, knurled surfaces, or the like and have not been illustrated in the description. It remains obvious for one skilled in the art to assume that these so described features may be included by reference and so have not been illustrated in this detailed description.

Figure 3E:
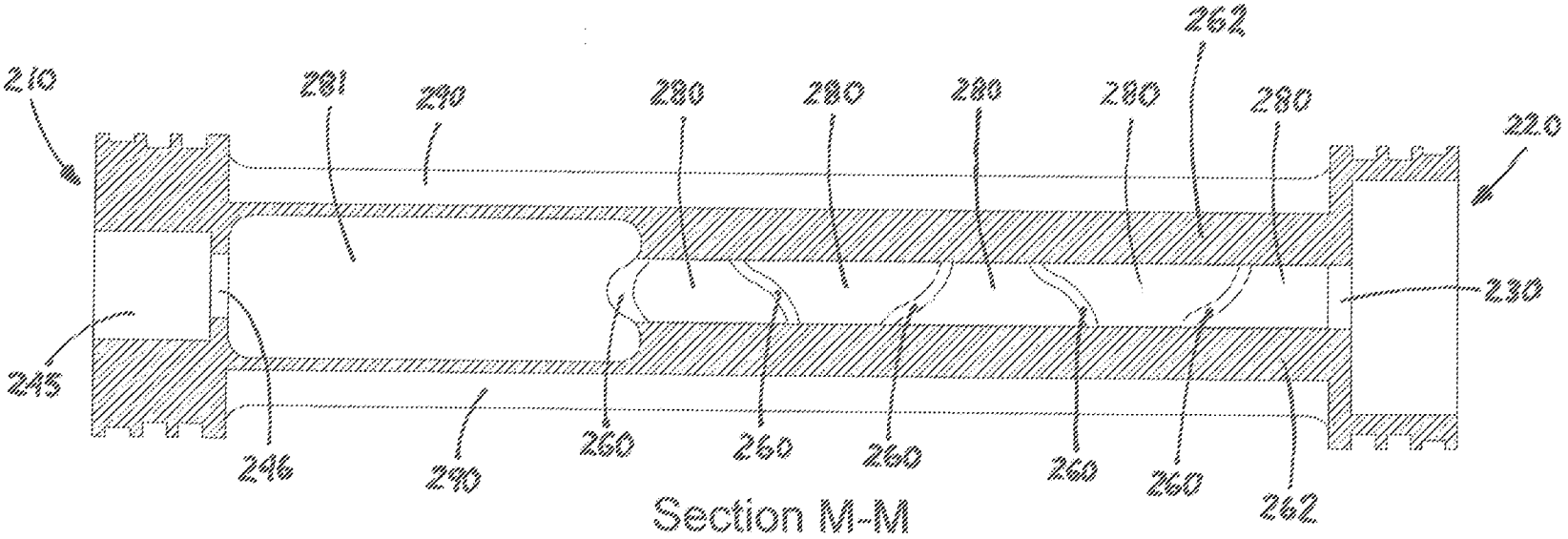
FIG. 3E is a cross-sectional view of monolithic baffle stack of FIG. 3A through Section F-F of FIG. 3A.

When a firearm is fired, propellant gases may be generated. These propellant gases may be generated for propelling a bullet out of an end of the firearm at a high velocity. Outer tube 110 may retain the propellant gases radially as the gases travel through silencer 100. Seals 252 may retain the propellant gases axially as the gases travel through the silencer. The monolithic baffle stack 200 may retain the propellant gases axially as the gases travel through the silencer, allow entry of the gases at only a single opening, allow exit of the gases at a controlled exit(s) (the preferred embodiment is described as having a common projectile and gas exit opening, and may have alternate embodiments not illustrated of secondary and other gas path exits in addition to the common projectile and gas exit opening), and facilitate the swirling of the propellant gases as they travel through silencer 100. For example, each of plurality of chambers 280 may be generally irregular in shape, and each of plurality of recesses 290 may be generally irregular in shape or contain obstructions (not shown) manufactured therein. As shown in FIG. 3A and FIG. 3E a view of each of plurality of recesses 290 may be generally in the shape of a cavity manufactured into the outside of the monolithic baffle stack 200. In some embodiments, each of the plurality of chambers 280 may be approximately of general 1 inch by 1 inch irregular profile cross-section feature size and extend as a cavity from the outer diameter surface of the monolithic baffle stack to protrusions. Each of the plurality of recesses 290 may be approximately 1⅛ inches by 5 inches and approximately 1/16 to ¾ inch deep at the deepest point. As shown in FIG. E, the location of the plurality of recesses 290 may be symmetrical with respect to a longitudinal axis extending from first end 2101 to second end 220 of monolithic baffle stack 200.

A first chamber 281 may be of irregular shape and of general feature size of 1 inch by 2 inches irregular profile cross-section and may extend through the monolithic baffle stack 200 as a continuous cavity. Said first chamber 281 may be in fluid communication with adjacent chambers 280 via holes 260. Said first chamber 281 may also be in fluid communication with the firearm bore source of propellant and projectile via holes 245 (and hole 246 if present). Said first chamber 281 may also be in fluid communication with adjacent recesses 290 via through holes 270. Said first chamber 281 may also be in fluid communication with adjacent recesses 290 and adjacent chambers 280 via annular void 115. A chamber 280 may be in fluid communication with adjacent chambers 280 through holes 160 and annular void 115, such that the propellant gases may travel from one chamber 280 to the next chamber 280. Similarly, a recess 290 may be in fluid communication with adjacent chambers 280 through annular void 115 and through holes 271 such that the propellant gases may travel from one recess 290 to adjacent chambers 280. One recess 290 may also be in fluid communication with other recesses 290 via chambers 280 or annular void 115, such that the propellant gases may travel from one recess 290 to the next recess 290 via one of the plurality of chambers 280, chamber 281, or annular void 115. One chamber 280 adjacent to hole 230 may also be in fluid communication with the outer atmosphere (exit opening at second end 220) via hole 230.

The shapes of chambers 280, chamber 281, hole 246 (if present), holes 260, protrusions 262, lands 261, through holes 270, through holes 271, recesses 290, hole 230, and the annular void distance between the inner diameter surface 113 of outer tube 110 and outer diameter surface 201 of monolithic baffle stack 200 may facilitate the swirling of the propellant gases inside silencer 100. As the propellant gases travel from the firearm bore to the atmosphere via the fluid communication paths heretofore described and encounter the shapes so described, the gases take many fluid paths as described, may split, recombine, swirl and execute other fluidic mixing movements while having their inherent velocity and pressure reduced as well as their net temperature reduced due to heat transfer to the silencer components. The gas dynamics so described may also exhibit time dependent functions depending on the interactions of the gases with the shapes, fluid communication paths, material properties of the silencer components, the atmospheric conditions in which the silencer is operated and the attributes of the propellant gases entering the silencer. The resultant of these gas dynamics is a reduction in velocity and temperature of the gases, and upon exiting the second end 130 of silencer 100 via hole 230, the gases exit in a slower and less violent manner. The slower and less violent exiting propellant gases results in a reduction in the sound intensity generated by firing of the firearm, or what in industry nomenclature is termed a reduction in decibels (a unit used to express the intensity of a sound wave).

Referencing FIG. 4A and FIG. 3E, a monolithic baffle stack 200 may include a path 295 extending from hole 245 through hole 230. It is contemplated that path 295 may vary in diameter to accept firearms projectile calibers (projectile outside diameters) from 0.17 inch to 0.500 inch, and hole 246 (if present) holes 260, lands 261 and hole 230 will be larger than the described path diameter by the previously discussed design relationships. It is contemplated that the propellant gases may travel from one end of silencer 100 and exit an opposite end of silencer 100 via path 295 while displaying the previously described fluid dynamics. Similarly, rifle projectiles (bullets) may travel from one end of silencer 100 and exit an opposite end of silencer 100 via path 295.

The silencer 100 described herein may be manufactured by a process that facilitates later disassembly, when desired. First, an outer tube 110 is provided. This component (as with other components) may be custom manufactured or purchased from another source. In some embodiments, outer tube 110 may be generally hollow and generally cylindrical in shape. It is contemplated that outer tube 110 may be in any other appropriate geometric shape. A monolithic baffle stack 200 may be provided. In some embodiments, monolithic baffle stack 200 may include a first end 210 including a hole 245. In some embodiments, monolithic baffle stack 200 may include a second end 220 including a hole 230, and second end 220 may be located at an opposite end of monolithic baffle stack 200. In some embodiments, monolithic baffle stack 200 may include a first chamber 281 and chambers 280 in fluid communication with each other via a plurality of holes 160, through holes 270, through holes 271, an annular void 115, and recesses 290 such that propellant gases may travel from first chamber 281 to an adjacent chamber 280. In some embodiments, monolithic baffle stack 200 may include a plurality of chambers 280 in fluid communication with each other via a plurality of holes 160, through holes 271, an annular void 115, and recesses 290 such that propellant gases may travel from one chamber 280 to an adjacent chamber 280. Similarly, in some embodiments, monolithic baffle stack 200 may include a plurality of recesses 290 in fluid communication with the plurality of chambers 280 and first chamber 281 via a plurality of through holes 270, through holes 271, and annular void 115, such that propellant gases may travel from one recess 290 to an adjacent chamber 280 and first chamber 281. Propellant gases may also travel from one recess 290 to another recess 290 for example.

In one exemplary embodiment, first end 210 of monolithic baffle stack 200 may position coaxially and limit the axial displacement (along the axis of outer tube 110) a first end 120 of outer tube 110 through the installation of seals 252. Seals 252 may be provided during the assembly process. In some embodiments, seals 252 may be selectively affixed to corresponding seal grooves 250 and 251 of monolithic baffle stack 210. Correspondingly, in one exemplary embodiment, second end 220 of monolithic baffle stack 200 may position coaxially and limit the axial displacement (along the axis of outer tube 110) a second end 130 of outer tube 110 through the installation of seals 252. Seals 252 for second end 130 may be provided during the assembly process. In some embodiments, seals 252 may be selectively affixed to corresponding seal grooves 254 and 255 of monolithic baffle stack 210. In some embodiments, outer tube 110 may be then coaxially placed over the seals 252 at both the first end 120 and second end 130. In the preferred embodiment, outer tube 110 first end 120 and second end 130 are manufactured identical, so the features of placement as to which end of outer tube 110 corresponds to which end of monolithic baffle stack 200 may be reversed with the outcome being the same to the functioning of the silencer 100. It may also be possible and apparent in the preferred embodiment to proceed from either end of monolithic baffle stack 200 (first end 210 or second end 220) in placing the outer tube 110 into coaxial position over the seals 252. Retention seals 253 may be provided during the assembly process. Retention seals 253 may be selectively affixed to corresponding seal grooves 240 and 241 of monolithic baffle stack 210 at both first end 210 and second end 220, and may then serve to retain outer tube 110 from axial movement relative to the monolithic baffle stack 200 along outer tube 110 axis. A path 295 extends from hole 245 of first end 210 of monolithic baffle stack 200 through hole 230 of second end 220 of monolithic baffle stack 200. Once silencer 100 is attached to a firearm and that firearm is discharged, a firearm projectile (bullet) (if present) travels through path 295. This is followed by propellant gases which may travel through hole 246 (if present) first chamber 281, the plurality of chambers 280, the plurality of recesses 290, holes 270, holes 271, annular void 115, hole 230 and path 295. Those skilled in the art would appreciate that as the propellant gases travel through the just described holes, chambers void, and paths, the velocity and temperature associated with the propellant gases may be reduced, thus resulting in a reduction in the sound intensity that are generated by a firearm.

The nature in which the described eight components (four distinct type components) have been assembled allows for relatively easy disassembly. This may prove advantageous in efficient disassembly to service and/or replace selected components. For example, components of silencer 100 may be removed for cleaning and/or inspection purposes. Those skilled in the art would appreciate that the repeated firing of ammunition may result in combustion byproduct deposit buildup inside a silencer over time. Eventually, the combustion byproduct buildup may be so severe that the silencer is no longer functional or its performance is partially impaired. Sometimes the combustion byproduct buildup may be so severe that a bullet may not be able to pass through the path in the monolithic baffle stack inside the silencer without making contact with the path holes or lands. In addition to combustion byproduct buildup, dirt may also be deposited from the environment inside the silencer. Cleaning the various components of the silencer 100 on a regular or as-needed basis may help to reduce the combustion byproduct and/or dirt buildup. The easy disassembly of silencer 100 facilitates such cleaning.

Further, as discussed above, the various components of silencer 100 may include seals, retention seals and seal grooves such that the components may be selectively positioned and retained with one another via the seal and retention installations. Those skilled in the art would also appreciate that because silencer 100 may be disassembled easily, any component of silencer 100 may be customized in order to be used with various calibers of firearms. For example, the diameters of outer tube 110, monolithic baffle stack 200, seals 252, and retention seals 253 may be altered and manufactured according to customer's specification. Similarly, the attachment method of hole 245 of monolithic baffle stack 200 and consequently the attachment method to the firearm may be altered and manufactured according to customer's specification. The ability to customize in this manner allows the various components of silencer 100 to be used with firearms of different manufacturers and also with different caliber firearms.

Figure 5:
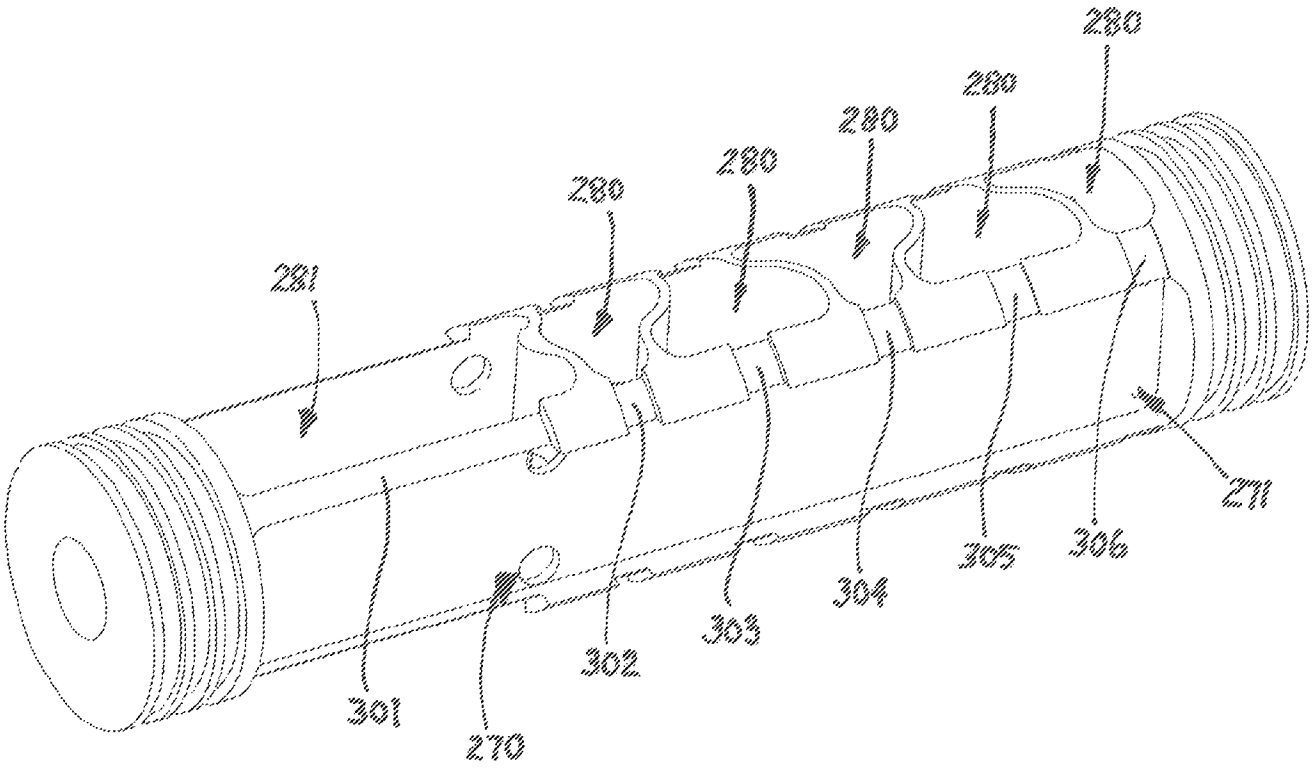
FIG. 5 is a perspective view of an alternate embodiment of monolithic baffle stack.

An alternate embodiment may now be described. Referring to FIG. 5, monolithic baffle stack 200 described previously is illustrated with the addition of plurality of circumferential passages 301, 302, 303, 304, 305, and 306, their number being for illustrative purposes only and may exist singularly or in plurality with similar feature dimensions or varied feature dimensions. As illustrated, the circumferential passages may increase in diameter from circumferential passage 301 to 306, provide for an additional annular void for fluid communication between chamber 281 and recesses 290, and each of the chambers 280 and recesses 290. While illustrated as such, one skilled in the art may contemplate other variations of the passage features, i.e. that the diameters, locations, widths, profile, presence with respect to a chamber, and circumferential segmental presence may all be varied and customized to further aid in creating fluid communication paths and resultant dynamic response characteristics of the assembled silencer 100. Said referenced circumferential passages may also augment or replace fluid communication through holes 270 and through holes 271 in some embodiments.

Figure 6B:
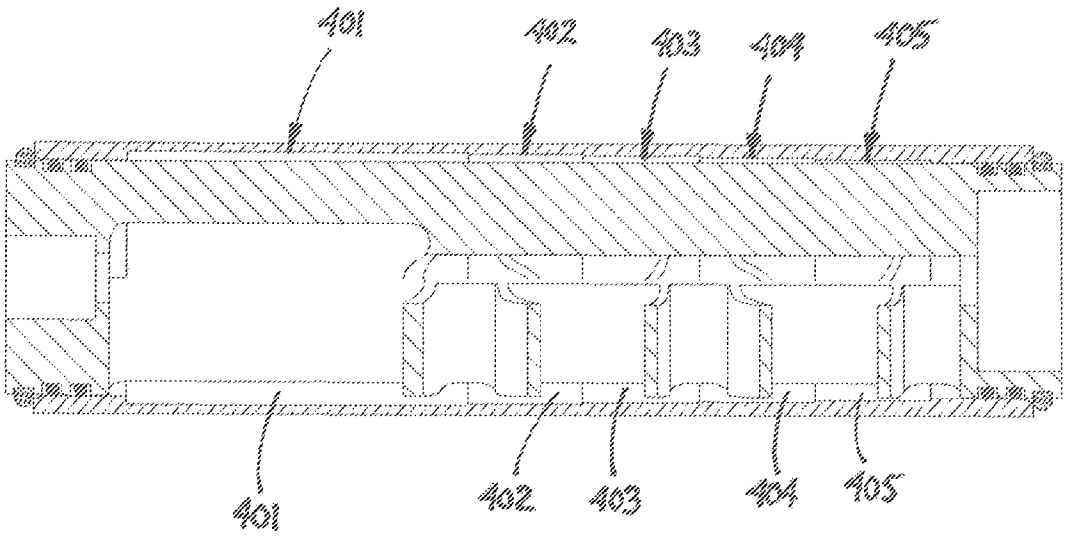
FIG. 6B is a cross-sectional side view of an alternate embodiment of firearm silencer referred to in FIG. 6A and shown through Section L-L of FIG. 6A.
Figure 6A:
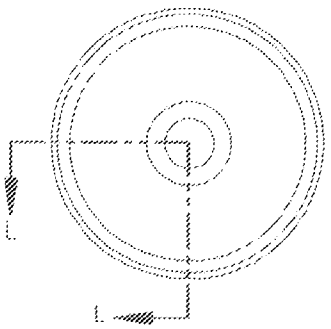
FIG. 6A is a first end view of an alternate embodiment of firearm silencer.

A further embodiment may be shown in FIGS. 6A and 6B. Whereas the embodiment shown in FIG. 5 may change the characteristics of the fluid communication paths of the silencer assembly via the change in the annular void geometry as a result of circumferential passages being added to the monolithic baffle stack 200, FIG. 6B embodies circumferential passages being applied to the inside diameter surface of outer tube 110. Plurality of circumferential passages 401, 402, 403, 404, and 405 are illustrated, their number being for illustrative purposes only and may exist singularly or in plurality with similar feature dimensions or varied feature dimensions. The shown circumferential passages may decrease in diameter from circumferential passage 401 to 405, provide for an additional annular void for fluid communication between chamber 281 and recesses 290, each of the chambers 280 and recesses 290, between several chambers 280, or between chambers 280 and chamber 281. While illustrated as such, one skilled in the art may contemplate other variations of the passage features, i.e. that the diameters, locations, widths, profile, presence with respect to a chamber, and circumferential segmental presence may all be varied and customized to further aid in creating fluid communication paths and resultant dynamic response characteristics of the assembled silencer 100. Said referenced circumferential passages may also augment or replace fluid communication through holes 270 and through holes 271 in some embodiments. One may also contemplate the use of circumferential passages 401, 402, 403, 404, 405 in conjunction or exclusively individually with circumferential passages 301, 302, 303, 304, 305, 306 to further create fluid communication customization within the silencer 100.

It will be apparent to those skilled in the art that various modifications and variations can be made in the disclosed silencer. It will also be apparent to those skilled in the art that while the method of assembling a silencer is disclosed with a specific order, that specific order is not required. Other embodiments will be apparent to those skilled in the art from consideration of the specification and practice of the disclosed embodiments herein. It is intended that the specification and examples be considered as exemplary only, with a true scope of the disclosure being indicated by the following claims.

What is claimed is:

1. A firearm silencer for suppressing sounds generated by the discharge of a firearm, the discharge generating propellant gases, the firearm silencer comprising:

an outer tube, the outer tube being generally hollow and generally cylindrical, with relieved edges at both ends of the internal diameter to ease assembly;

a plurality of seal disposed between the outer tube and a monolithic baffle stack within the length of the outer tube, the seals being generally elastomeric in composition and generally toroidal in shape;

a plurality of retention seals being disposed upon the monolithic baffle stack such that the outer tube is positioned between the retention seals, the seals being generally elastomeric in composition and generally toroidal in shape;

a monolithic baffle stack inserted within the outer tube and disposed such that the monolithic baffle stack projects beyond both ends of the outer tube including:

a first end including a first hole, a second end including a second hole, the second end located opposite the first end of the monolithic baffle stack, a plurality of chambers in fluid communication with each other via a plurality of holes and an annular void, the annular void being enclosed by the outer tube;

a plurality of recesses in fluid communication with the plurality of chambers via a plurality of through holes and an annular void, the through holes and annular void being enclosed by the outer tube, wherein the recesses are cavities with respect to the outer tube, wherein the one or more of the plurality of recesses has a first depth at a first circumferential location on the monolithic baffle stack and a second depth at a second circumferential location on the monolithic baffle stack, the first depth being greater than the second depth, wherein the plurality of recesses are not annular recesses;

a plurality of protrusions extending from the chamber walls radially inward relative to a longitudinal axis extending from the first end of the monolithic baffle stack to the second end of the monolithic baffle stack, within the chambers, and having a terminating surface land profile cylindrical between adjacent chambers, and said terminating surface land being co-radial to hole in fluid communication between chambers, so as to equal a continuous cylindrical bore dimension of the holes and lands;

and a path extending from the first hole adjacent the first end of the monolithic baffle stack through the first hole adjacent the second end of the monolithic baffle stack, wherein the plurality of chambers, the plurality of recesses, the annular void, the through holes, the protrusions, the terminating surface lands, and the path are configured to allow propellant gases to travel there through.

2. The firearm silencer of claim 1, wherein the monolithic baffle stack includes:

a single or plurality of annular groove for seal at the first end of the monolithic baffle stack for selectively securing seal therein such that the first end of the outer tube is concentrically secured to the first end of the monolithic baffle stack, an annular void between the outer tube and monolithic baffle stack is formed, and an atmospheric sealing is achieved between the annular void and the external atmosphere of the firearm silencer at the first end of the monolithic baffle stack;

a single or plurality of annular groove for seal at the second end of the monolithic baffle stack for selectively securing seal therein such that the second end of the outer tube is concentrically secured to the second end of the monolithic baffle stack, an annular void between the outer tube and monolithic baffle stack is formed, and an atmospheric sealing is achieved between the annular void and the external atmosphere of the firearm silencer at the second end of the monolithic baffle stack;

an annular groove at the first end of the monolithic baffle stack, disposed between annular groove for seal and the first end of the monolithic baffle stack, so featured so as to not allow for installation of the outer tube over a retention seal, for selectively securing retention seal therein such that the outer tube is axially constrained inboard of the retention seal at the monolithic baffle stack first end;

and an annular groove at the second end of the monolithic baffle stack, disposed between the annular groove for seal and the second end of the monolithic baffle stack, so featured so as to not allow for installation of the outer tube over the retention seal, for selectively securing a retention seal therein such that the outer tube is axially constrained inboard of the retention seal at the monolithic baffle stack second end.

3. The firearm silencer of claim 1, wherein the monolithic baffle stack includes no welded joints.

4. The firearm silencer of claim 1, wherein the monolithic baffle stack includes at least four chambers in fluid communication with each other via the plurality of holes and annular void.

5. The firearm silencer of claim 1, wherein the monolithic baffle stack is between about 4 inches to about 16 inches in length.

6. The firearm silencer of claim 1, wherein the plurality of through holes are symmetrical with respect to a longitudinal axis extending from the first end of the monolithic baffle stack to the second end of the monolithic baffle stack.

7. The firearm silencer of claim 1, wherein the seal are of a high temperature polymer compound using silicone rubber, tetrafluoroethylene propylene, or perfluoroelastomer as the compound primary constituent.

8. The firearm silencer of claim 1, where the retention seal are of a high temperature polymer compound using silicone rubber, tetrafluoroethylene propylene, or perfluoroelastomer as the compound primary constituent.

9. A firearm silencer for suppressing sounds generated by the discharge of a firearm, the firearm silencer comprising:

an outer tube;

a plurality of seal disposed between the outer tube and a monolithic baffle stack within the length of the outer tube, the seals being generally elastomeric in composition;

a monolithic baffle stack inserted within the outer tube including:

a first end including a first hole, a second end including a second hole, the second end located opposite the first end of the monolithic baffle stack, a plurality of chambers in fluid communication with each other via a plurality of holes and an annular void, the annular void being enclosed by the outer tube;

a plurality of recesses in fluid communication with the plurality of chambers via a plurality of through holes and an annular void, the through holes and annular void being enclosed by the outer tube, wherein the recesses are cavities with respect to the outer tube, wherein the one or more of the plurality of recesses has a first depth at a first circumferential location on the monolithic baffle stack and a second depth at a second circumferential location on the monolithic baffle stack, the first depth being greater than the second depth, wherein the plurality of recesses are not annular recesses;

and a path extending from the first hole adjacent the first end of the monolithic baffle stack through the first hole adjacent the second end of the monolithic baffle stack, wherein the plurality of chambers, the plurality of recesses, the annular void, the through holes, and the path are configured to allow propellant gases to travel there through.

10. The firearm silencer of claim 9, wherein the monolithic baffle stack includes:

a single or plurality of annular groove for seal at the first end of the monolithic baffle stack for selectively securing seal therein such that the first end of the outer tube is concentrically secured to the first end of the monolithic baffle stack, an annular void between the outer tube and monolithic baffle stack is formed, and an atmospheric sealing is achieved between the annular void and the external atmosphere of the firearm silencer at the first end of the monolithic baffle stack;

and a single or plurality of annular groove for seal at the second end of the monolithic baffle stack for selectively securing seal therein such that the second end of the outer tube is concentrically secured to the second end of the monolithic baffle stack, an annular void between the outer tube and monolithic baffle stack is formed, and an atmospheric sealing is achieved between the annular void and the external atmosphere of the firearm silencer at the second end of the monolithic baffle stack.

11. The firearm silencer of claim 9, wherein the monolithic baffle stack includes no welded joints.

* * * * *